United States Patent [19]

Horio et al.

[11] Patent Number: 4,658,769

[45] Date of Patent: Apr. 21, 1987

[54] V-TYPE INTERNAL COMBUSTION ENGINE WITH CENTRALLY LOCATED DRIVE GEARS COUPLING DOUBLE OVERHEAD CAMSHAFTS

[75] Inventors: Kimihide Horio; Yasunobu Kikuchi; Hiroya Fujita, all of Toyota, Japan

[73] Assignee: Toyota Jidosha Kabushiki Kaisha, Japan

[21] Appl. No.: 844,107

[22] Filed: Mar. 26, 1986

[30] Foreign Application Priority Data

Apr. 17, 1985 [JP] Japan ..... 60-057363[U]

[51] Int. Cl.[4] ..... F01L 1/02

[52] U.S. Cl. ..... 123/90.31; 123/90.27; 123/DIG. 7

[58] Field of Search ..... 123/90.31, 90.27, DIG. 6, 123/DIG. 7, DIG. 8

[56] References Cited

U.S. PATENT DOCUMENTS

| | | | |
|---|---|---|---|
| 3,673,990 | 4/1972 | Alfieri | 123/90.31 |
| 3,732,745 | 5/1973 | Jackson | 123/90.27 |
| 4,380,216 | 4/1983 | Kandler | 123/90.31 |
| 4,480,603 | 11/1984 | Tsuboi | 123/90.31 |

*Primary Examiner*—Ira S. Lazarus

*Attorney, Agent, or Firm*—Parkhurst & Oliff

[57] ABSTRACT

This V-type engine has first and second banks of cylinders, each odd in number, with first intake and exhaust cam shafts provided along the first cylinder head and second intake and exhaust cam shafts provided along the second cylinder head. One of the first intake and exhaust cam shafts, and one of the second intake and exhaust cam shafts, is rotationally driven from the crank shaft. A first intake cam shaft gear wheel is provided on the first intake cam shaft at a longitudinal position between the middle cylinder of the first bank of cylinders and the next cylinder to the rear from the middle cylinder, and a first exhaust cam shaft gear wheel, meshed with this first intake cam shaft gear wheel, is provided on the first exhaust cam shaft at a similar longitudinal position between the middle cylinder of the first bank of cylinders and the next cylinder to the rear therefrom. A second intake cam shaft gear wheel is provided on the second intake cam shaft at a longitudinal position between the middle cylinder of the second bank of cylinders and the next cylinder to the front from the middle cylinder, and a second exhaust cam shaft gear wheel, meshed with this second intake cam shaft gear wheel, is provided on the second exhaust cam shaft at a similar longitudinal position between the middle cylinder of the second bank of cylinders and the next cylinder to the front therefrom. Thereby, the bulges corresponding to these meshed pairs of gear wheels are brought as close together as practicable.

6 Claims, 2 Drawing Figures

V-TYPE INTERNAL COMBUSTION ENGINE WITH CENTRALLY LOCATED DRIVE GEARS COUPLING DOUBLE OVERHEAD CAMSHAFTS

BACKGROUND OF THE INVENTION

The present invention relates to the field of double overhead cam shaft type V type internal combustion engines, and more specifically relates to a novel configuration for such an engine which has an odd number of cylinders in each of its two cylinder banks, which provides good manufacturability and operational characteristics for the engine.

A V type internal combustion engine of a so called double overhead cam shaft configuration is per se known. Each cylinder bank of such an engine has, provided along its cylinder head, an intake cam shaft and an exhaust cam shaft, each of which is provided with cams which typically press directly on the ends of valve stems of intake and exhaust poppet valves for the cylinders of that cylinder bank. This construction is inevitably complicated and has a large number of components, and accordingly it is desired to simplify it by reducing diversity of parts to as great a degree as possible, from the point of view of manufacturing convenience and reduction of cost, as well as from the point of view of minimizing the problems of parts stocking and inventory. Yet, in the prior art, because all the parts for the left and right cylinder heads and their associated valve gear such as the intake and exhaust cam shafts have been different, a great diversity of components has persisted. In this connection, reference should be made to copending patent application Ser. No. 780,609, assigned now U.S. Pat. No. 4,610,224 or under an obligation of assignment to the same assignee as the present patent application, which suggests a new configuration for such cylinder heads and their associated valve gear which allows the cylinder heads and the cam shafts of the left and right cylinder banks to be identical but reversed in orientation; however, it is not intended hereby to admit said copending patent application as prior art to the present application except to the extent otherwise required by law.

Further, all these four cam shafts are required to be driven from the crank shaft of the engine in a determinate phase relationship therewith. Accordingly, drive means must be provided for driving each of them. If all these four cam shafts are individually driven directly from the engine crank shaft, as has heretofore been practiced as for example via a timing chain or drive belt, then the problem arises that it is hard to make the engine compact.

SUMMARY OF THE INVENTION

On the other hand, if in each cylinder head one of the intake and the exhaust cam shafts is driven from the engine crank shaft, and the other said cam shaft is driven from said driven cam shaft, then problems can arise with regard to rigidity of the arrangement, noise, wear characteristics, and positioning of the oil ways therefor.

The present inventors have conceived that in the particular case of a double overhead cam shaft type V type engine which has an odd number of cylinders in each cylinder bank, there might be a practicable solution to such a problem.

Accordingly, it is the primary object of the present invention to provide a V type internal combustion engine, which avoids the above described problems.

It is a further object of the present invention to provide such a V type internal combustion engine, which is compact.

It is a further object of the present invention to provide such a V type internal combustion engine, which provides good minimization of numbers of different components and thus helps with stocking and parts inventory control.

It is a yet further object of the present invention to provide such a V type internal combustion engine, which has good manufacturability.

It is a yet further object of the present invention to provide such a V type internal combustion engine, which has good rigidity characteristics for the cam shafts.

It is a yet further object of the present invention to provide such a V type internal combustion engine, which has good noise characteristics.

It is a yet further object of the present invention to provide such a V type internal combustion engine, which has good wear characteristics.

It is a yet further object of the present invention to provide such a V type internal combustion engine, for which the oil ways for the cam shafts and cylinder heads can be provided in more or less the same positions on each side.

According to the most general aspect of the present invention, these and other objects are accomplished by a V-type internal combustion engine, comprising: a crank shaft; a first bank of cylinders, odd in cardinality; a second bank of cylinders, of the same odd cardinality as said first bank of cylinders, longitudinally offset to the rear from said first bank of cylinders and arranged in a V configuration with respect thereto; a first cylinder head provided along said first bank of cylinders; a second cylinder head provided along said second bank of cylinders; a first intake cam shaft and a first exhaust cam shaft, rotatably mounted along said first cylinder head for valve actuation; means for rotationally driving from said crank shaft one of said first intake cam shaft and said first exhaust cam shaft; a second intake cam shaft and a second exhaust cam shaft, rotatably mounted along said second cylinder head for valve actuation; means for rotationally driving from said crank shaft one of said second intake cam shaft and said second exhaust cam shaft; a first intake cam shaft gear wheel, provided on said first intake cam shaft at a longitudinal position between the middle cylinder of said first bank of cylinders and the next cylinder to the rear from said middle cylinder; a first exhaust cam shaft gear wheel, provided on said first exhaust cam shaft at a longitudinal position between the middle cylinder of said first bank of cylinders and the next cylinder to the rear from said middle cylinder, and meshed with said first intake cam shaft gear wheel; a second intake cam shaft gear wheel, provided on said second intake cam shaft at a longitudinal position between the middle cylinder of said second bank of cylinders and the next cylinder to the front from said middle cylinder; a second exhaust cam shaft gear wheel, provided on said second exhaust cam shaft at a longitudinal position between the middle cylinder of said second bank of cylinders and the next cylinder to the front from said middle cylinder, and meshed with said second intake cam shaft gear wheel.

According to the present invention as described above, the left and the right cylinder heads can be manufactured as the same part, as can the left and right intake cam shafts and the left and right exhaust cam shafts. This makes for economies of manufacture and eases stocking and parts inventory problems. Further, because the means for rotationally coupling together the intake and the exhaust cam shafts on each cylinder bank, i.e. the gear wheels mounted thereon, are as central as practicable on their individual cylinder banks, and further said means on the two banks are located as close together to one another as possible, thereby rigidity of the construction is enhanced, and noise and wear characteristics of the engine are improved. Further, the oil ways are more or less in the same place on either side, which is very convenient.

Further, according to a more specialized aspect of the present invention, these and other objects are accomplished by an engine as described above, which is a V6 type engine; or alternatively by such an engine which is a V10 type engine.

BRIEF DESCRIPTION OF THE DRAWINGS

The present invention will now be shown and described with regard to certain of the preferred embodiments thereof, and with reference to the illustrative drawings, which however should not be considered as limitative of the present invention in any way, since the scope of the present invention is to be considered as being delimited solely by the accompanying claims, rather than by any particular features of the disclosed embodiments or of the drawings. In these drawings:

DESCRIPTION OF THE PREFERRED EMBODIMENTS

Figure 1:
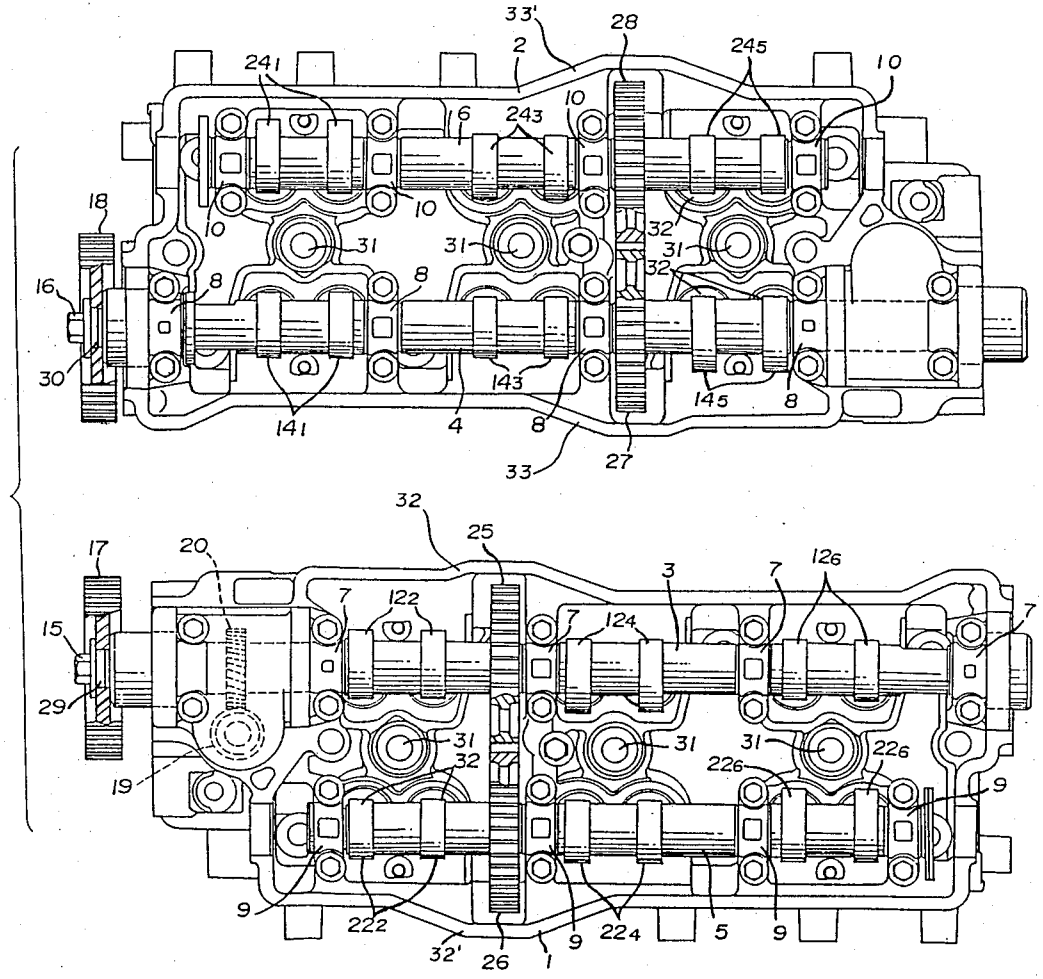
FIG. 1 is a combined view from above showing both of the two heads of a double overhead cam shaft type V6 engine which is the first preferred embodiment of the engine of the present invention.

The present invention will now be described with reference to the preferred embodiments thereof. FIG. 1 partially shows the first preferred embodiment of the V type engine of the present invention, which is a V6 cylinder engine with three cylinders, an odd number, in each of its two cylinder banks, which are not particularly shown: the odd numbered cylinders numbers one, three, and five are in the right cylinder bank, while the even numbered cylinders numbers two, four, and six are in the left cylinder bank. In this figure, the reference numeral 1 denotes the cylinder head for the left bank of cylinders, while 2 is the cylinder head for the right bank of cylinders. The front of the engine is on the left side of FIG. 1, and accordingly the right cylinder bank is offset or displaced towards the left of the figure with respect to the left cylinder bank, by half the distance between adjacent cylinders on either cylinder head. Although these banks of cylinders are fitted to an engine block (not shown either) in a V configuration at a so called bank angle as is per se known, and although accordingly in fact the general planes of the cylinder heads 1 and 2 of the engine are inclined to one another at a considerable angle, nevertheless for the sake of viewing simplicity FIG. 1 shows both said left and right cylinder heads 1 and 2 each from directly above it, as though said general planes of said heads were coplanar. As will become clear from the following, the left and the right cylinder heads 1 and 2 are in fact identical parts, however being fitted to their respective cylinder banks in opposite orientations, i.e. at 180 degrees to one another. The screws 31 are for holding the left and the right cylinder heads 1 and 2 on to their respective cylinder blocks.

To the left cylinder head 1 there are fitted an intake cam shaft 3 for actuating the intake valves, not particularly shown because they lie underneath said left intake cam shaft 3 but herein denoted as 11, of the left bank cylinder chambers of the engine, and an exhaust cam shaft 5 for actuating the exhaust valves, not shown either because similarly they lie underneath said left exhaust cam shaft 5 but herein denoted as 21, of said left cylinder bank. In fact, for each of the six cylinders of the shown first preferred embodiment of the engine of the present invention, there are provided two intake valves and two exhaust valves, and accordingly each engine cylinder has four ports; however, this is not intended to be limitative of the present invention. These cam shafts 3 and 5 are arranged in parallel along the longitudinal direction of the engine, i.e. along the rows of the cylinders. The left intake cam shaft 3 is rotatably supported from the left cylinder head 1 by a plurality of bearing means 7, and similarly the left exhaust cam shaft 5 is rotatably supported from said left cylinder head 2 by a plurality of bearing means 9. Similarly, to the right cylinder head 2 there are fitted an intake cam shaft 4 for actuating the intake valves, again not particularly shown because they lie underneath said right intake cam shaft 4 but herein denoted as 13, of the right bank cylinder chambers of the engine, and an exhaust cam shaft 6 for actuating the exhaust valves, not shown either because similarly they lie underneath said right exhaust cam shaft 6 but herein denoted as 23, of said right cylinder bank. These cam shafts 4 and 6 are again arranged in parallel along the longitudinal direction of the engine, i.e. along the rows of the cylinders. The right intake cam shaft 4 is rotatably supported from the right cylinder head 2 by a plurality of bearing means 8, and similarly the right exhaust cam shaft 6 is rotatably supported from said right cylinder head 2 by a plurality of bearing means 10. The two intake cam shafts 3 and 4 are located on the inside sides of their left and right cylinder heads 1 and 2 respectively, i.e. on the inside of the V shape defined by the banks of cylinders, and the two exhaust cam shafts 5 and 6 are located on the outside sides of said left and right cylinder heads 1 and 2 respectively: this arrangement, as is per se known, provides great advantages over possible alternatives with regard to the intake and exhaust porting and manifolding arrangements for the engine as a whole.

On the left intake cam shaft 3 there are formed three pairs of cam lobes 12 for the three pairs of intake valves 11 of the three even numbered cylinders of the left cylinder bank of the engine: the pair of intake cam lobes 12-2, 12-2 drives the pair of intake valves 11 of cylinder number two, the pair of intake cam lobes 12-4, 12-4 drives the pair of intake valves 11 of cylinder number four, and the pair of intake cam lobes 12-6, 12-6 drives the pair of intake valves 11 of cylinder number six. Similarly, on the right intake cam shaft 4 there are formed three pairs of cam lobes 14 for the three pairs of intake valves 13 of the three odd numbered cylinders of the right cylinder bank of the engine: the pair of intake cam lobes 14-1, 14-1 drives the pair of intake valves 13 of cylinder number one, the pair of intake cam lobes 14-3, 14-3 drives the pair of intake valves 13 of cylinder number three, and the pair of intake cam lobes 14-5, 14-5 drives the pair of intake valves 13 of cylinder number five. And, at the front ends of said left and right intake cam shafts 3 and 4, there are respectively fitted, by fixing bolts 15 and 16 and washers 29 and 30 respectively, cam shaft drive pulleys 17 and 18. These drive pulleys 17 and 18 are driven via a timing chain (not particularly shown) from the crank shaft (not shown either) of the engine. Thus, the left and right intake cam shafts 3 and 4 are synchronously rotated in a determinate mutual phase relationship. And on the left side intake cam shaft 3 there is fitted a distributor drive gear 20, which meshes with a distributor gear 19 fitted on the power input shaft to a distributor, not otherwise shown. No corresponding arrangements are particularly provided on the right side of the engine, and this portion of the right side intake cam shaft 4 is instead blanked off.

In a like manner, with regard to the camming arrangements for the exhaust valves, on the left exhaust cam shaft 5 there are formed three pairs of cam lobes 22 for the three pairs of exhaust valves 21 of the three even numbered cylinders of the left cylinder bank of the engine: the pair of exhaust cam lobes 22-2, 22-2 drives the pair of exhaust valves 21 of cylinder number two, the pair of exhaust cam lobes 22-4, 22-4 drives the pair of exhaust valves 21 of cylinder number four, and the pair of exhaust cam lobes 22-6, 22-6 drives the pair of exhaust valves 21 of cylinder number six. Similarly, on the right exhaust cam shaft 6 there are formed three pairs of cam lobes 24 for the three pairs of exhaust valves 23 of the three odd numbered cylinders of the right cylinder bank of the engine: the pair of exhaust cam lobes 24-1, 24-1 drives the pair of exhaust valves 23 of cylinder number one, the pair of exhaust cam lobes 24-3, 24-3 drives the pair of exhaust valves 23 of cylinder number three, and the pair of exhaust cam lobes 24-5, 24-5 drives the pair of exhaust valves 23 of cylinder number five.

On the left intake cam shaft 3 there is provided a driving gear wheel 25 housed in a lateral bulge 32 on the inner side of the left cylinder head 1, and on the left exhaust cam shaft 5 there is provided a driven gear wheel 26 housed in a lateral bulge 32' on the outer side of the left cylinder head 1 and meshed with and with the same number of teeth as said driving gear wheel 25; thereby, said left exhaust cam shaft 5 is rotationally driven from said left intake cam shaft 3 at the same rotational speed as it but in the reverse rotational direction, and in a determinate phase relationship thereto. Similarly, on the right intake cam shaft 4 there is provided a driving gear wheel 27 housed in a lateral bulge 33 on the inner side of the right cylinder head 2, and on the right exhaust cam shaft 6 there is provided a driven gear wheel 28 housed in a lateral bulge 33' on the outer side of the right cylinder head 2 and meshed with and with the same number of teeth as said driving gear wheel 27; thereby, said right exhaust cam shaft 6 is rotationally driven from said right intake cam shaft 4 at the same rotational speed as it but in the reverse rotational direction, and in a determinate phase relationship thereto.

Particularly according to the concept of the present invention, on the right cylinder bank which is the cylinder bank which is the more offset or displaced towards the front end of the engine (the left side of the figure), the driving gear wheel 27 on the right intake cam shaft 4 is provided between the middle cylinder of said right cylinder bank and the next cylinder towards the rear of said right cylinder bank, i.e., in this case of a six cylinder engine, between the cylinders numbers three and five; and correspondingly the driven gear wheel 28 on the right exhaust cam shaft 6 is likewise provided between the middle cylinder of said right cylinder bank and the next cylinder towards the rear of said right cylinder bank, i.e., in this case between the cylinders numbers three and five. In a similar manner, according to the identical but reversed configuration of the left cylinder bank which is the cylinder bank which is the more offset or displaced towards the rear end of the engine, the driving gear wheel 25 on the left intake cam shaft 3 is provided between the middle cylinder of said left cylinder bank and the next cylinder towards the front of said left cylinder bank, i.e., in this case between the cylinders numbers two and four; and correspondingly the driven gear wheel 26 on the left exhaust cam shaft 5 is likewise provided between the middle cylinder of said left cylinder bank and the next cylinder towards the front of said left cylinder bank, i.e., in this case between the cylinders numbers two and four. The effect of this arrangement is that these pairs of driving and driven gear wheels are located as close as possible to the longitudinal centers of the cam shafts and to one another, and that accordingly the lateral bulge 32 on the inner side of the left cylinder head 1, in which the driving gear wheel 25 on the left intake cam shaft 3 is housed, is as close as possible in the longitudinal direction to the lateral bulge 33 on the inner side of the right cylinder head 2, in which the driving gear wheel 27 on the right intake cam shaft 4 is housed. This provides the benefits that the left and the right cylinder heads 1 and 2 can be manufactured as the same part, as can the left and right intake cam shafts 3 and 4 and the left and right exhaust cam shafts 5 and 6. This makes for economies of manufacture and eases stocking and parts inventory problems. Further, because the means for rotationally coupling together the intake and the exhaust cam shafts on each cylinder bank, i.e. the gear wheels 25, 26, 27 and 28 mounted thereon, are as central as practicable on their individual cylinder banks, and further said means on the two banks are located as close together to one another as possible, thereby rigidity of the construction is enhanced, and noise and wear characteristics of the engine are improved. Further, the oil ways are more or less in the same place on either side, which is very convenient.

Figure 2:
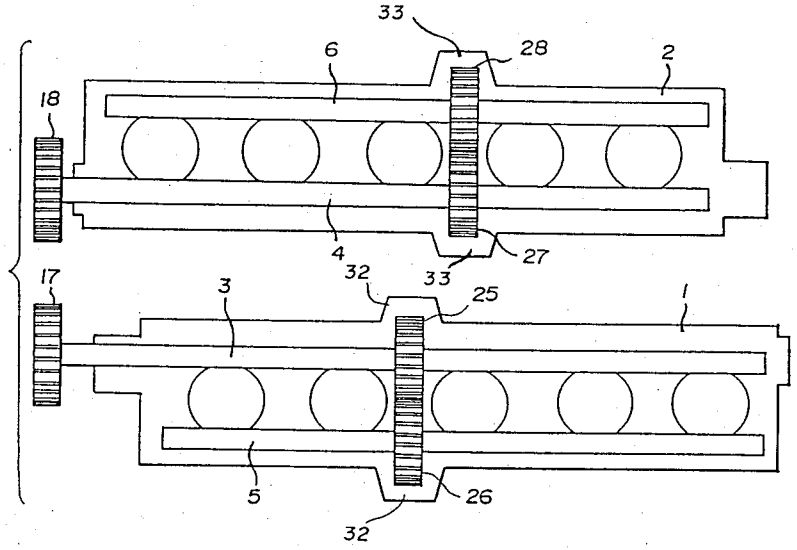
FIG. 2 is a similar but more schematic view showing both of the two heads of a V10 engine which is the second preferred embodiment.

In FIG. 2, there is shown, in a manner similar to that of FIG. 1 but more schematically, the second preferred embodiment of the V type engine of the present invention, which is a V10 cylinder engine with five cylinders, an odd number, in each of its two cylinder banks—the right one of which again is displaced towards the front of the engine (the left side of FIG. 2) and incorporates the odd cylinders numbers one, three, five, seven, and nine, while the left of said cylinder banks is displaced towards the rear of the engine and incorporates the even cylinders numbers two, four, six, eight, and ten. The constructional details of this second preferred embodiment are omitted because they are similar, mutatis mutandis, to the details of the first preferred embodiment shown in FIG. 1. In this second preferred embodiment, the driving gear wheel 27 on the right intake cam shaft 4, which again is on the bank of cylinders which is displaced towards the front of the engine, is according to the same inventive concept provided between the middle cylinder of said right cylinder bank and the next cylinder towards the rear of said right cylinder bank, i.e., in this case of a ten cylinder engine, between the cylinders numbers five and seven; and correspondingly the driven gear wheel 28 on the right exhaust cam shaft 6 is likewise provided between the middle cylinder of said right cylinder bank and the next cylinder towards the rear of said right cylinder bank, i.e., in this case between the cylinders numbers five and seven. In a similar manner, according to the identical but reversed configuration of the left cylinder bank which is the cylinder bank which is the more offset or displaced towards the rear end of the engine, the driving gear wheel 25 on the left intake cam shaft 3 is provided between the middle cylinder of said left cylinder bank and the next cylinder towards the front of said left cylinder bank, i.e., in this case between the cylinders numbers four and six; and correspondingly the driven gear wheel 26 on the left exhaust cam shaft 5 is likewise provided between the middle cylinder of said left cylinder bank and the next cylinder towards the front of said left cylinder bank, i.e., in this case between the cylinders numbers four and six. The same advantages are reaped in this second preferred embodiment with regard to the positioning of the lateral bulges 32 and 33 of the cylinder heads 1 and 2, and with regard to other matters, as were obtained in the case of the first preferred embodiment shown in FIG. 1.

Although the present invention has been shown and described in terms of certain preferred embodiments thereof, and with reference to the appended drawings, it should not be considered as being particularly limited thereby. The details of any particular embodiment, or of the drawings, could be varied without, in many cases, departing from the ambit of the present invention. Accordingly, the scope of the present invention is to be considered as being delimited, not by any particular perhaps entirely fortuitous details of the disclosed preferred embodiments, or of the drawings, but solely by the legitimate and properly interpreted scope of the accompanying claims, which follow.

What is claimed is:

1. A V-type internal combustion engine, comprising:

a crank shaft;

a first bank of cylinders, odd in cardinality;

a second bank of cylinders, of the same odd cardinality as said first bank of cylinders, longitudinally offset to the rear from said first bank of cylinders and arranged in a V configuration with respect thereto;

a first cylinder head provided along said first bank of cylinders;

a second cylinder head provided along said second bank of cylinders;

a first intake cam shaft and a first exhaust cam shaft, rotatably mounted along said first cylinder head for valve actuation;

means for rotationally driving from said crank shaft one of said first intake cam shaft and said first exhaust cam shaft;

a second intake cam shaft and a second exhaust cam shaft, rotatably mounted along said second cylinder head for valve actuation;

means for rotationally driving from said crank shaft one of said second intake cam shaft and said second exhaust cam shaft;

a first intake cam shaft gear wheel, provided on said first intake cam shaft at a longitudinal position between the middle cylinder of said first bank of cylinders and the next cylinder to the rear from said middle cylinder;

a first exhaust cam shaft gear wheel, provided on said first exhaust cam shaft at a longitudinal position between the middle cylinder of said first bank of cylinders and the next cylinder to the rear from said middle cylinder, and meshed with said first intake cam shaft gear wheel;

a second intake cam shaft gear wheel, provided on said second intake cam shaft at a longitudinal position between the middle cylinder of said second bank of cylinders and the next cylinder to the front from said middle cylinder;

a second exhaust cam shaft gear wheel, provided on said second exhaust cam shaft at a longitudinal position between the middle cylinder of said second bank of cylinders and the next cylinder to the front from said middle cylinder, and meshed with said second intake cam shaft gear wheel.

2. A V-type internal combustion engine according to claim 1, wherein said first cylinder head is formed with a first bulge which houses said first intake cam shaft gear wheel and said first exhaust cam shaft gear wheel, and said second cylinder head is formed with a second bulge which houses said second intake cam shaft gear wheel and said second exhaust cam shaft gear wheel.

3. A V-type internal combustion engine according to claim 1, wherein said first bank of cylinders is three in cardinality.

4. A V-type internal combustion engine according to claim 1, wherein said first bank of cylinders is five in cardinality.

5. A V-type internal combustion engine, comprising:

a crank shaft;

a first bank of three cylinders;

a second bank of three cylinders, longitudinally offset to the rear from said first bank of cylinders and arranged in a V configuration with respect thereto;

a first cylinder head provided along said first bank of cylinders;

a second cylinder head provided along said second bank of cylinders;

a first intake cam shaft and a first exhaust cam shaft, rotatably mounted along said first cylinder head for valve actuation;

means for rotationally driving from said crank shaft one of said first intake cam shaft and said first exhaust cam shaft;

a second intake cam shaft and a second exhaust cam shaft, rotatably mounted along said second cylinder head for valve actuation;

means for rotationally driving from said crank shaft one of said second intake cam shaft and said second exhaust cam shaft;

a first intake cam shaft gear wheel, provided on said first intake cam shaft at a longitudinal position between the middle cylinder of said first bank of cylinders and the rear cylinder thereof;

a first exhaust cam shaft gear wheel, provided on said first exhaust cam shaft at a longitudinal position between the middle cylinder of said first bank of cylinders and the rear cylinder thereof, and meshed with said first intake cam shaft gear wheel;

a second intake cam shaft gear wheel, provided on said second intake cam shaft at a longitudinal position between the front cylinder of said second bank of cylinders and the middle cylinder thereof;

a second exhaust cam shaft gear wheel, provided on said second exhaust cam shaft at a longitudinal position between the front cylinder of said second bank of cylinders and the middle cylinder thereof, and meshed with said second intake cam shaft gear wheel.

6. A V-type internal combustion engine, comprising:

a crank shaft;

a first bank of five cylinders;

a second bank of five cylinders, longitudinally offset to the rear from said first bank of cylinders and arranged in a V configuration with respect thereto;

a first cylinder head provided along said first bank of cylinders;

a second cylinder head provided along said second bank of cylinders;

a first intake cam shaft and a first exhaust cam shaft, rotatably mounted along said first cylinder head for valve actuation;

means for rotationally driving from said crank shaft one of said first intake cam shaft and said first exhaust cam shaft;

a second intake cam shaft and a second exhaust cam shaft, rotatably mounted along said second cylinder head for valve actuation;

means for rotationally driving from said crank shaft one of said second intake cam shaft and said second exhaust cam shaft;

a first intake cam shaft gear wheel, provided on said first intake cam shaft at a longitudinal position between the third cylinder from the front of said first bank of cylinders and the fourth cylinder from the front thereof;

a first exhaust cam shaft gear wheel, provided on said first exhaust cam shaft at a longitudinal position between the third cylinder from the front of said first bank of cylinders and the fourth cylinder from the front thereof, and meshed with said first intake cam shaft gear wheel;

a second intake cam shaft gear wheel, provided on said second intake cam shaft at a longitudinal position between the second cylinder from the front of said second bank of cylinders and the third cylinder from the front thereof;

a second exhaust cam shaft gear wheel, provided on said second exhaust cam shaft at a longitudinal position between the second cylinder from the front of said second bank of cylinders and the third cylinder from the front thereof, and meshed with said second intake cam shaft gear wheel.

* * * * *